US006702688B2

(12) United States Patent
Hale

(10) Patent No.: US 6,702,688 B2
(45) Date of Patent: Mar. 9, 2004

(54) GOLF PUTTER TRAINING SYSTEM

(76) Inventor: Brad R. Hale, 20 Catamaran #202, Marina del Rey, CA (US) 90292

( * ) Notice: Subject to any disclaimer, the term of this patent is extended or adjusted under 35 U.S.C. 154(b) by 0 days.

(21) Appl. No.: 10/235,157

(22) Filed: Sep. 3, 2002

(65) Prior Publication Data

US 2004/0009825 A1 Jan. 15, 2004

Related U.S. Application Data

(60) Provisional application No. 60/394,769, filed on Jul. 10, 2002.

(51) Int. Cl.[7] ..... A63B 69/36

(52) U.S. Cl. ..... 473/226; 473/235; 473/236; 473/242; 473/251; 473/257; 473/409

(58) Field of Search ..... 473/235, 236, 473/238, 242, 244, 251, 409, 261, 262, 263, 264, 265, 223, 226, 227, 231, 286, 257; D21/753, 759

(56) References Cited

U.S. PATENT DOCUMENTS

| | | | | | |
|---|---|---|---|---|---|
| 2,057,821 | A | * | 10/1936 | Costello | 473/235 |
| 4,002,343 | A | | 1/1977 | Eckert | |
| 4,846,477 | A | | 7/1989 | Phelan | |
| 4,909,515 | A | | 3/1990 | Redkey | |
| 5,011,153 | A | * | 4/1991 | Watkins | 473/236 |
| 5,228,332 | A | | 7/1993 | Bernhardt | |
| 5,351,962 | A | | 10/1994 | Lin | |
| 5,441,268 | A | | 8/1995 | Shier | |
| 5,476,262 | A | | 12/1995 | Bandiero | |
| 5,810,675 | A | * | 9/1998 | Weathers | 473/236 |
| D402,724 | S | | 12/1998 | Minami | |
| 5,924,935 | A | * | 7/1999 | Prewitt | 473/236 |
| 6,270,422 | B1 | | 8/2001 | Fisher | |
| 6,379,259 | B1 | | 4/2002 | Opie | |
| 6,435,975 | B2 | * | 8/2002 | Middleton | 473/231 |
| 2002/0016212 | A1 | | 2/2002 | Middleton | |

* cited by examiner

*Primary Examiner*—Sebastiano Passaniti
(74) *Attorney, Agent, or Firm*—Pendorf & Cutliff

(57) ABSTRACT

A golf putter training system for developing a controlled putter head velocity and acceleration during a putting swing. The golf putter training system includes a body having a rear portion and a front portion, a main aperture within the body for receiving a conventional golf ball in a rotatable manner, a rear opening within the rear portion of the body connected to the main aperture, a plurality of brace members extending below the lower edge of the putter head, and a plurality of lower members and upper members extending from the rear portion for receiving a plurality of connector members. The connector members are attachable about the putter head thereby securing the body thereto. A plurality of apertures may be positioned within the rear portion of the body for receiving an elongate attachment member that is attachable to the shaft of the putter club. Alternative, a first bracket and a second bracket maybe attached to the body for receiving the connectors.

18 Claims, 9 Drawing Sheets

GOLF PUTTER TRAINING SYSTEM

CROSS REFERENCE TO RELATED APPLICATIONS

I hereby claim benefit under Title 35, United States Code, Section 119(e) of U.S. provisional patent application Ser. No. 60/394,769 filed Jul. 10, 2002. The Ser. No. 60/394,769 application is currently pending. The Ser. No. 60/394,769 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to putting aides and more specifically it relates to a golf putter training system for developing a controlled putter head velocity and acceleration during a putting swing.

2. Description of the Related Art

Conventional putting aides are typically comprised of complex structures that are designed to assist, the golfer with their shot alignment. Many putting aides are comprised of complex mechanical structures that allegedly assist in the putter swing. Other putting aides that have an aperture within the putter head behind the face of the putter head. Additional putting aides provide attachments to an existing putter head that form an aperture behind the putter head.

The main problem with conventional putting aides is that they are bulky and difficult to utilize. Another problem with conventional putting aides is that they do not effectively assist in the development of a controlled putting swing. Another problem with conventional putting aides is that they sometimes are not designed for both left-handed and right-handed golfers. A further problem with conventional putting aides is that they sometimes significantly alter the balance and weight of the putter club. Another problem with conventional putting aides is that they sometimes require the usage of a putter device different from their preferred putter club. Another problem with conventional putting aides is that they do not provide feedback from an actual golf ball. Conventional putting aides also do not prevent a golfer from undesirably decelerating or improperly accelerating the putter head during the putting swing.

Examples of patented devices which may be related to the present invention include U.S. Pat. No. 0,016,212 to Middleton; U.S. Pat. No. 4,002,343 to Eckert; U.S. Pat. No. 5,476,262 to Bandiero; U.S. Pat. No. 5,351,962 to Lin; U.S. Pat. No. 6,379,259 to Opie; U.S. Pat. No. 4,909,515 to Redkey; U.S. Pat. No. 402,724 to Minami; U.S. Pat. No. 4,846,477 to Phelan; U.S. Pat. No. 5,441,268 to Shier; U.S. Pat. No. 5,228,332 to Bernhardt; and U.S. Pat. No. 6,270, 422 to Fisher.

While these devices may be suitable for the particular purpose to which they address, they are not as suitable for developing a controlled putter head velocity and acceleration during a putting, swing. Conventional putting aides are complex and difficult to effectively utilize in the development of a controlled putting swing.

In these respects, the golf putter training system according to the present invention substantially departs from the conventional concepts and designs of the prior art, and in so doing provides an apparatus primarily developed for the purpose of developing a controlled putter head velocity and acceleration during a putting swing.

BRIEF SUMMARY OF THE INVENTION

In view of the foregoing disadvantages inherent in the known types of putting aides now present in the prior art, the present invention provides a new golf putter training system construction wherein the same can be utilized for developing a controlled putter head velocity and acceleration during a putting swing.

The general purpose of the present invention, which will be described subsequently in greater detail, is to provide a new golf putter training system that has many of the advantages of the putting aides mentioned heretofore and many novel features that result in a new golf putter training system which is not anticipated, rendered obvious, suggested, or even implied by any of the prior art putting aides, either alone or in any combination thereof.

To attain this, the present invention generally comprises a body having a rear portion and a front portion, a main aperture within the body for receiving a conventional golf ball in a rotatable manner, a rear opening within the rear portion of the body connected to the main aperture, a plurality of brace members extending below the lower edge of the putter head, and a plurality of lower members and upper members extending from the rear portion for receiving a plurality of connector members. The connector members are attachable about the putter head thereby securing the body thereto. A plurality of apertures may be positioned within the rear portion of the body for receiving an elongate attachment member that is attachable to the shaft of the putter club.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a golf putter training system that will overcome the shortcomings of the prior art devices.

A second object is to provide a golf putter training system for developing a controlled putter head velocity and acceleration during a putting swing.

Another object is to provide a golf putter training system that is removably attached to an existing putter club.

An additional object is to provide a golf putter training system that may be removably attached to a putter head in various manners.

A further object is to provide a golf putter training system that is attachable to various designs and sizes of putter clubs.

An additional object is to provide a golf putter training system that provides immediate feedback regarding their putting swing.

A further object is to provide a golf putter training system that indicates to the golfer when they are improperly accelerating or decelerating the putter head during a putting swing.

Another object is to provide a golf putter training system that allows a golfer to both aim and shoot at a target with a regulation golf ball.

A further object is to provide a golf putter training system that allows a golfer to swing a putter club in a pendulum manner with a ball freely rolling within.

Another object is to provide a golf putter training system that may be utilized by both right-handed and left-handed golfers.

A further object is to provide a golf putter training system that does not significantly alter the physical characteristics of a putter club.

Another object is to provide a golf putter training system that improves a golfer's putting swing.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
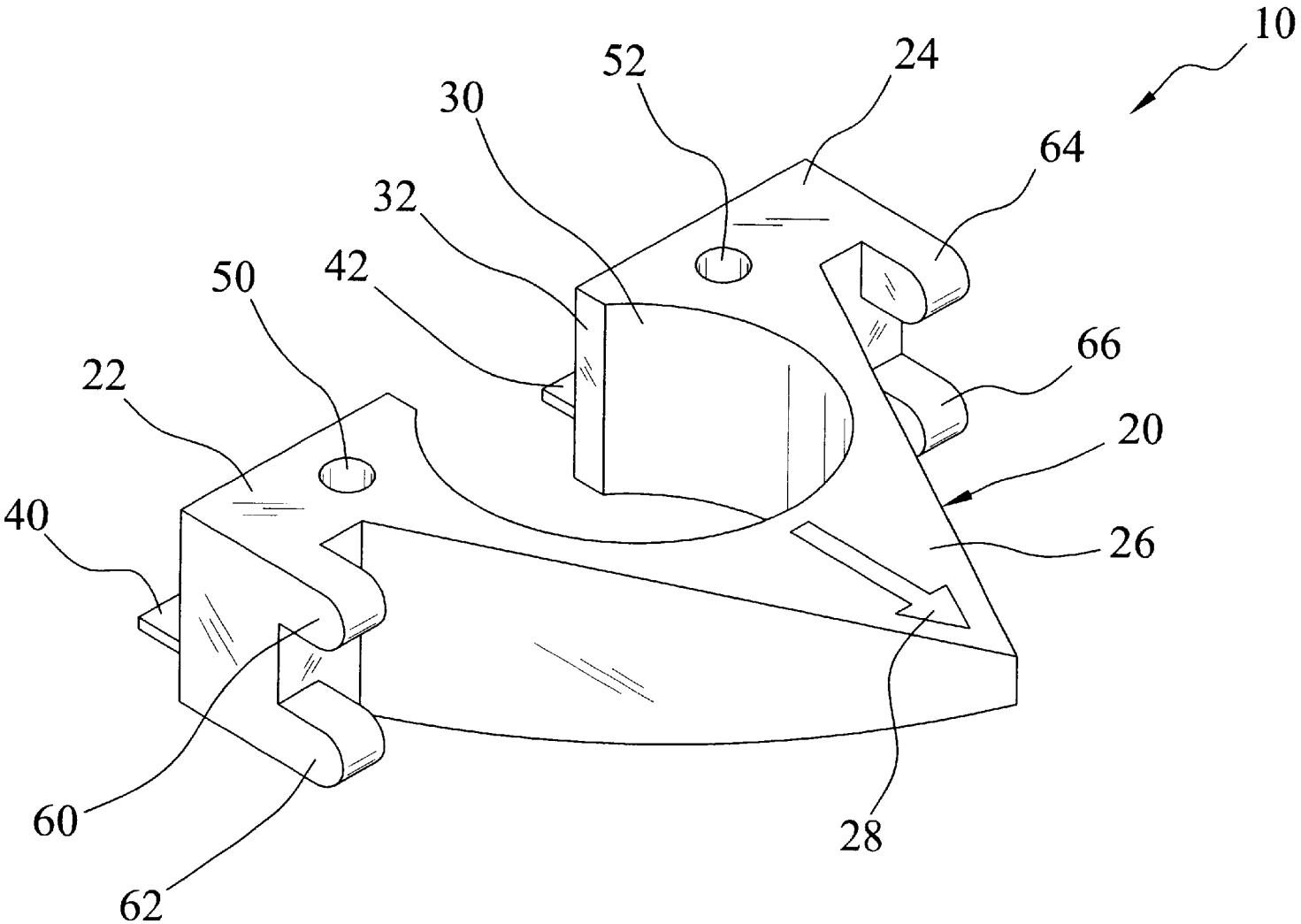
FIG. 1 is a front upper perspective view of the present invention.

Turning now descriptively to the drawings, in which similar reference characters denote similar elements throughout the several views, FIGS. 1 through 9 illustrate a golf putter training system 10, which comprises a body 20 having a rear portion 22, 24 and a front portion 26, a main aperture 30 within the body 20 for receiving a conventional golf ball 18 in a rotatable manner, a rear opening 32 within the rear portion 22, 24 of the body 20 connected to the main aperture 30, a plurality of brace members extending below the lower edge of the putter head 16, and a plurality of lower members and upper members extending from the rear portion 22, 24 for receiving a plurality of connector members. The connector members are attachable about the putter head 16 thereby, securing the body 20 thereto. A plurality of apertures may be positioned within the rear portion 22, 24 of the body 20 for receiving an elongate attachment member 70 that is attachable to the shaft 14 of the putter club 12.

Figure 2:
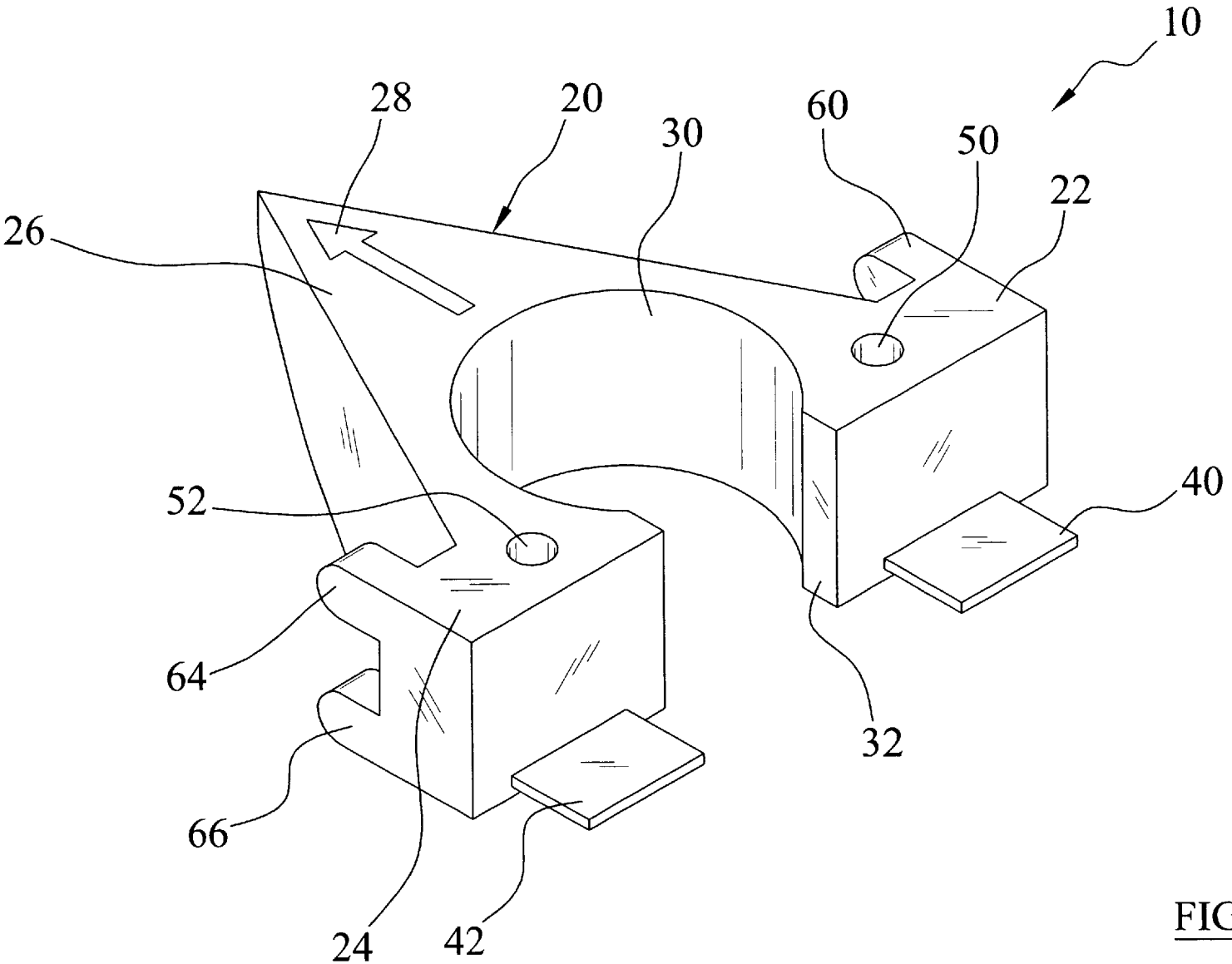
FIG. 2 is a rear upper perspective view of the present invention.
Figure 3:
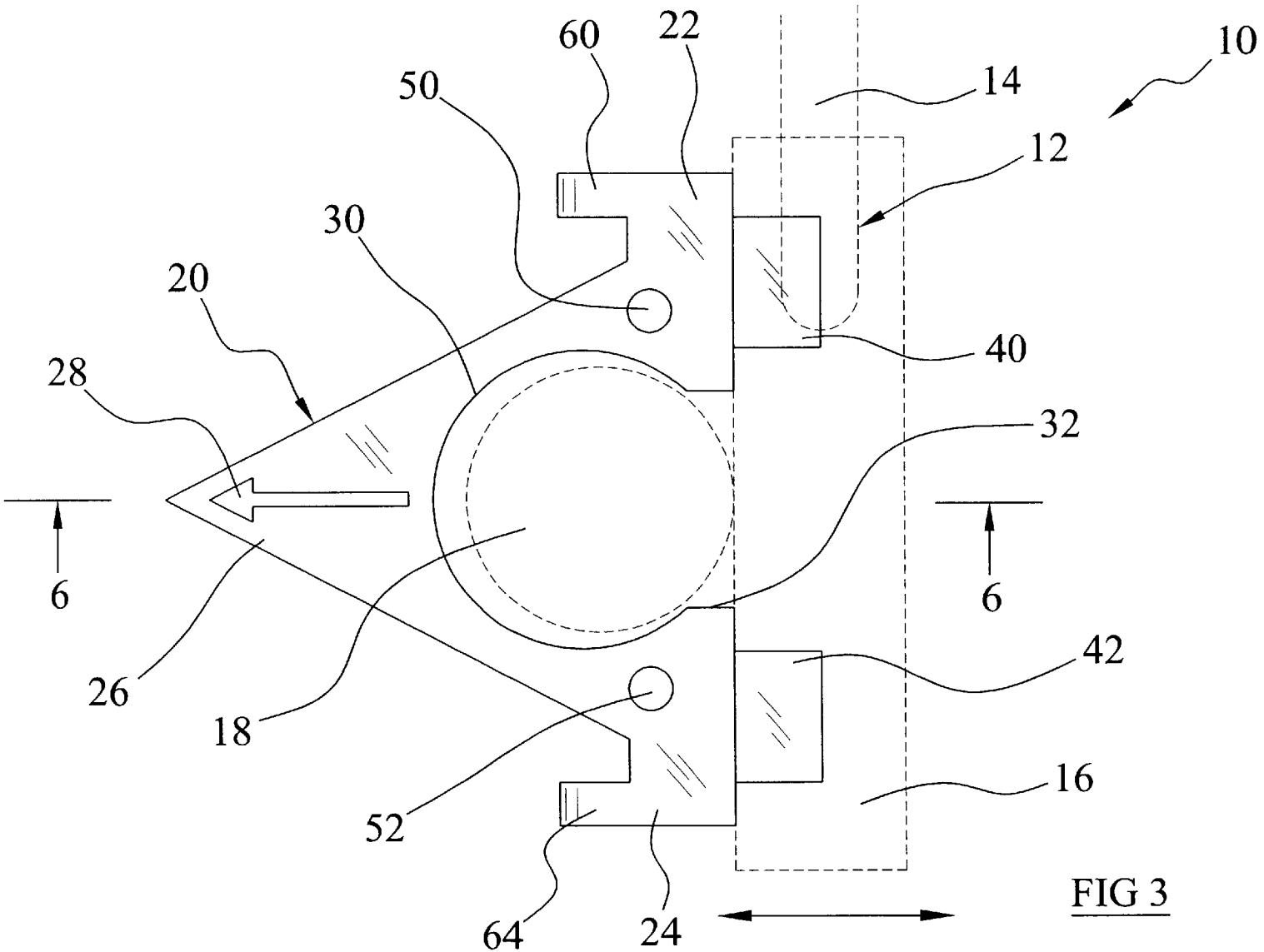
FIG. 3 is a top view of the present invention attached to a putter head.

As shown in FIGS. 1 through 5 of the drawings, the body 20 is preferably is comprised of a front portion 26, a first rear portion 22 and a second rear portion 24. The body 20 may have various shapes and sizes that are suitable for attachment to a putter head 16. However, the body 20 preferably has a tapered structure forming a V-shape extending toward the direction of the desired travel of the golf ball 18 as best illustrated in FIG. 3 of the drawings. The rear edge of the rear portion 22, 24 preferably has a straight and flat structure for allowing non-movably positioning adjacent the face of the putter head 16. The front portion 26 of the body 20 preferably is tapered upwardly as shown in FIGS. 6*a–d* of the drawings to reduce engagement with a ground surface during a putter swing. The body 20 is preferably comprised of a lightweight material such as but not limited to metal, plastic, fiberglass, wood, or composite material. The body 20 may be comprised of a solid, semi-solid or hollow structure.

A direction indicia 28 is preferably positioned within an upper surface of the body 20 for indicating the desired direction of travel of the putter head 16. The direction indicia 28 is preferably comprised of an arrow shaped structure or line structure, however various other indicia capable of indicating a desired direction may also be utilized. The direction indicia 28 is preferably positioned within the front portion 26 of the body 20 as further shown in FIG. 3 of the drawings.

As shown in FIGS. 1 through 7 of the drawings, the body 20 includes a main aperture 30 within for receiving a conventional sized golf ball 18 in a loose and rotatable manner. The main aperture 30 preferably has a circular cross sectional shape, however various other shapes such as oval or square may be utilized. A circular shape for the main aperture 30 provides the desired feedback to the golfer when the golf ball 18 engages the wall of the main aperture 30.

The main aperture 30 preferably has a size sufficient to loosely receive a conventional golf ball 18 as illustrated in FIG. 3 of the drawings. A regulation golf ball 18 in the United States has an outer diameter no less than 1.68 inches. A regulation golf ball 18 in the United Kingdom has an outer diameter no less than 1.62 inches. The main aperture 30 preferably has a diameter or width greater than the outer diameter of the golf ball 18.

The main aperture 30 preferably has a diameter at least equal to the diameter of the desired golf ball 18 plus 0.04 inches. For example, golf balls 18 having an outer diameter of 1.68 inches, the main aperture 30 would have a diameter of at least 1.72 inches. For golf balls 18 having an outer diameter of 1.62 inches, the main aperture 30 would have a diameter of at least 1.66 inches. The main aperture 30 has a diameter greater than outside diameter of the golf ball 18 by at least 0.01 inches. However, it is preferably to maintain the golf ball 18 slightly non-movably within the main aperture 30 other than rotatably to provide for increased immediate feedback to the golfer during the putter swing.

As further shown in FIGS. 1 through 5 of the drawings, a rear opening 32 extends to the main aperture 30 between the first rear portion 22 and the second rear portion 24 of the body 20. The rear opening 32 is sufficient in width for allowing the golf ball 18 to engage the face of the putter head 16 as shown in FIG. 3 of the drawings. However, the rear opening 32 preferably has a width less than the diameter of the main aperture 30 as best illustrated in FIG. 3 of the drawings. The rear opening 32 may be comprised of a straight or tapered structure designed to preferably guide the golf ball 18 to a desired location upon the putter head 16.

As shown in FIG. 2 of the drawings, a first brace member 40 and a second brace member 42 extend from a lower edge of the first rear portion 22 and the second rear portion 24 respectively. The first brace member 40 and the second brace member 42 are preferably comprised of a flat structure that prevents upwardly movement of the body 20 with respect to the putter head 16 during operation of the present invention.

Figure 4:
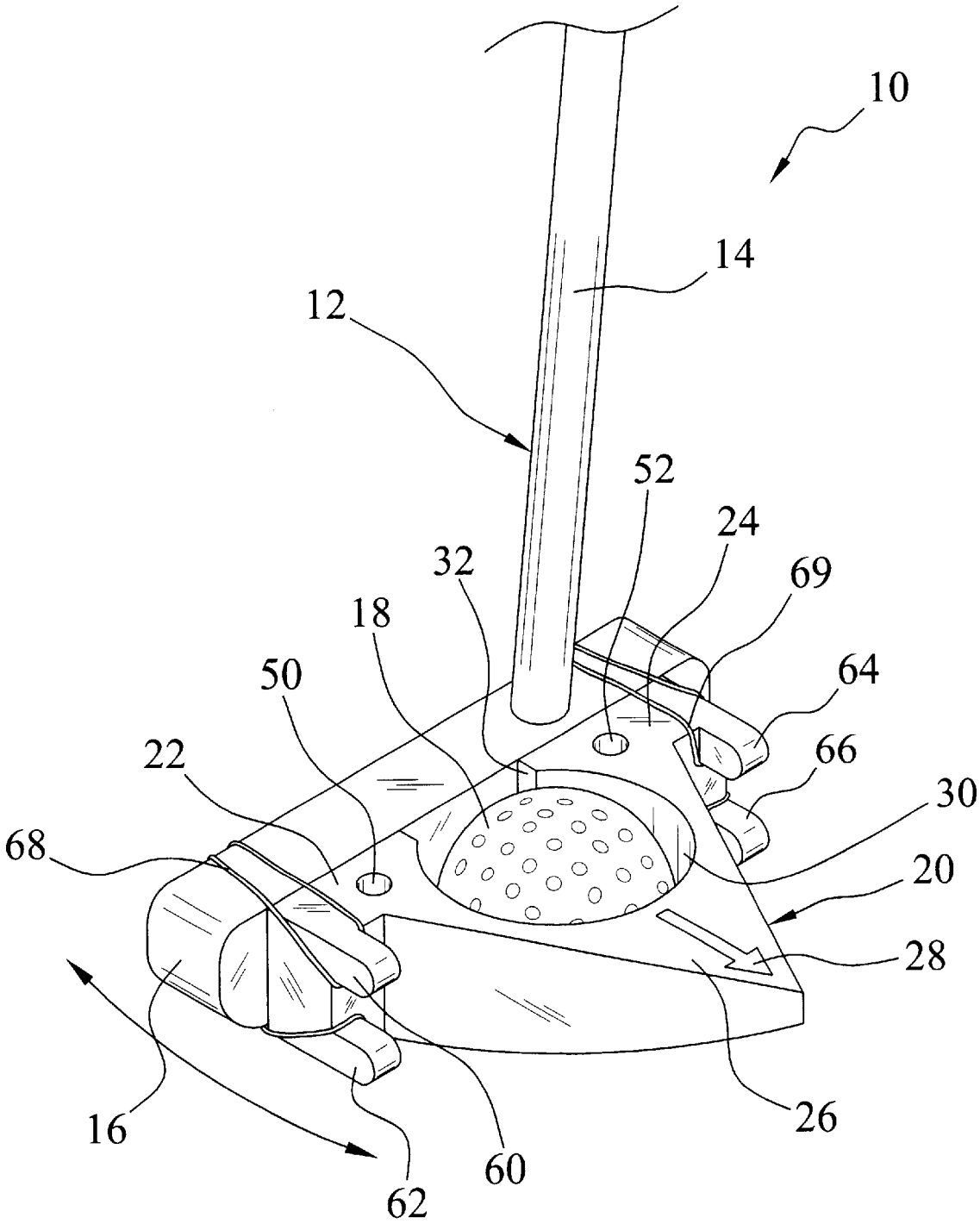
FIG. 4 is a front upper perspective view of the present invention attached to a putter head with a golf ball positioned within.
Figure 5:
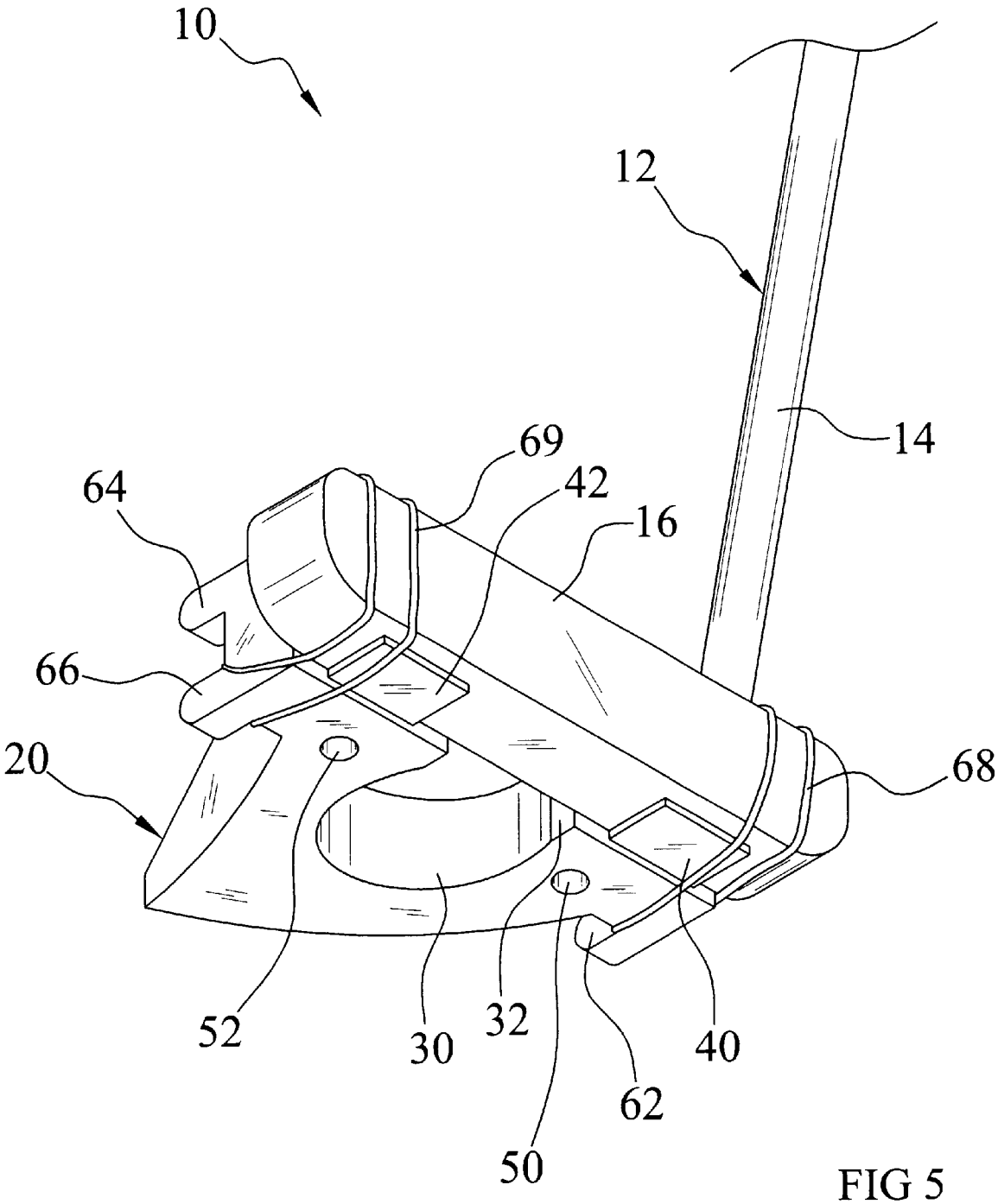
FIG. 5 is a lower rear perspective view of the present invention attached to a putter head.

As shown in FIG. 1 of the drawings, a first upper member 60 and a first lower member 62 extend forwardly from the first rear portion 22. The first upper member 60 and the first lower member 62 are comprised of an extended structure that allows for a corresponding first connector 68 to secure about the putter head 16 and connect at opposing ends thereof to the first upper member 60 and the first lower member 62 as shown in FIGS. 4 and 5 of the drawings. The first connector 68 may be comprised of various elongate fastening devices such as but not limited to wire, cord, plastic straps, rubber bands, neoprene strips, elastic bands, non-elastic bands, hook and loop fastener strips and the like. The first connector 68 preferably has a looped structure wherein the distal ends of the looped structure are removably engaged about the first upper member 60 and the first lower member 62.

As shown in FIG. 1 of the drawings, a second upper member 64 and a second lower member 66 extend forwardly from the second rear portion 24. The second upper member 64 and the second lower member 66 are comprised of an extended structure that allows for a corresponding second connector 69 to secure about the putter head 16 and connect at opposing ends thereof to the second upper member 64 and the second lower member 66 as shown in FIGS. 4 and 5 of the drawings. The second connector 69 may be comprised of various elongate fastening devices such as but not limited to wire, cord, plastic straps, rubber bands, neoprene strips, elastic bands, non-elastic bands, hook and loop fastener strips and the like. The second connector 69 preferably has a looped structure wherein the distal ends of the looped structure are removably engaged about the second upper member 64 and the second lower member 66. It can be appreciated that the body 20 may be attached to the putter head 16 using other attachment devices such as but not limited to clamps, fasteners, magnets, apertures and protrusions, attachment brackets, adhesives or suction cups.

Figure 7:
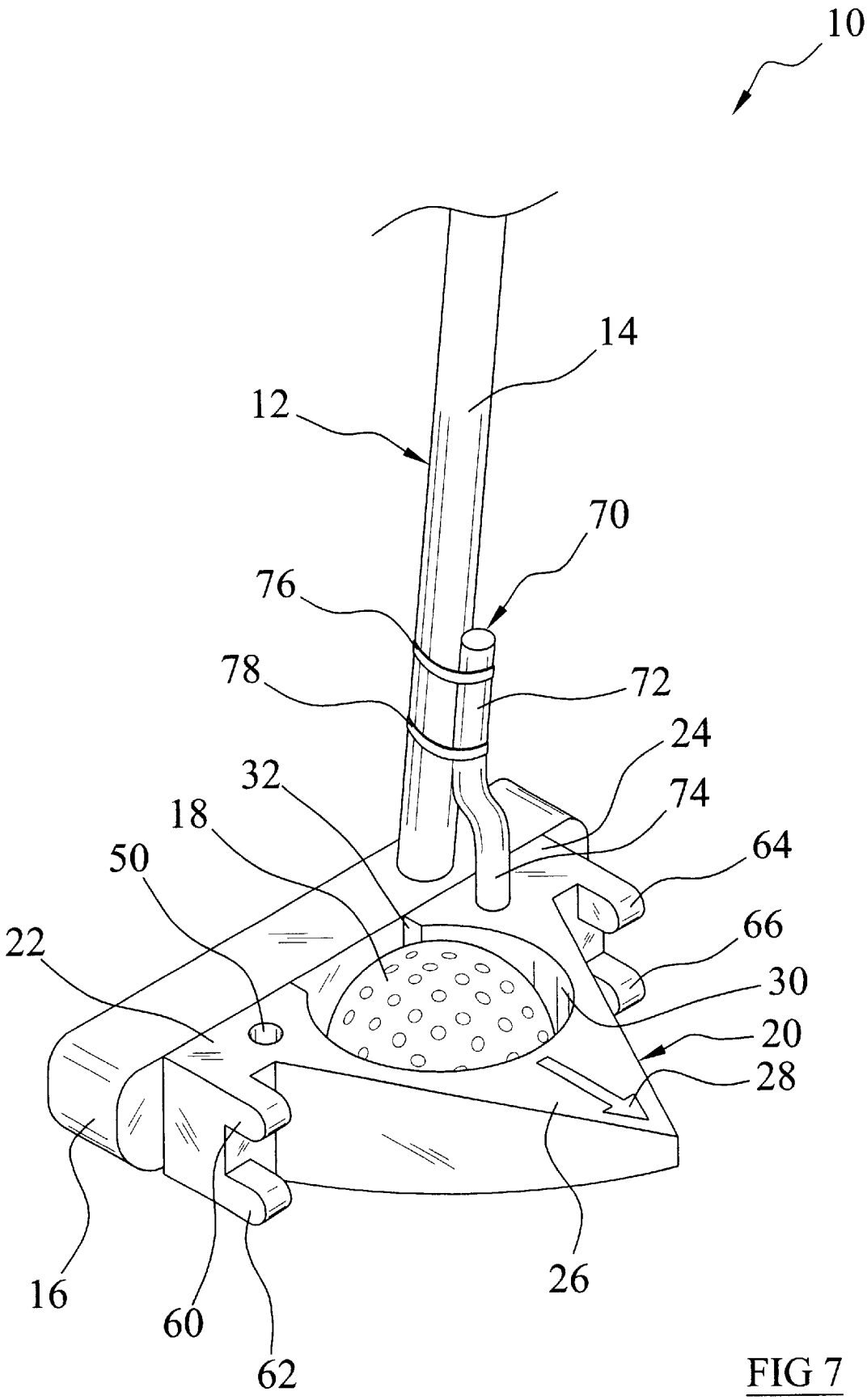
FIG. 7 is a front upper perspective view of the present invention disclosing an alternative attachment method.

As shown in FIGS. 1 through 4 of the drawings, a first aperture 50 and a second aperture 52 preferably extend into the upper surface of the first rear portion 22 and the second rear portion 24 respectively. The first aperture 50 and the second aperture 52 are preferably formed to snugly receive an elongate attachment member 70 having an upper portion 72 and a lower portion 74 as illustrated in FIG. 7 of the drawings. The lower portion 74 is preferably non-concentric with the upper portion 72, though the lower portion 74 is preferably substantially parallel to the upper portion 72 of the attachment member 70. A third connector 76 and a fourth connector 78 are preferably utilized to secure the attachment member 70 to the shaft 14 of the putter club 12 as further shown in FIG. 7 of the drawings. It can be appreciated that only the third connector 76 may be utilized to secure the attachment member 70. The third connector 76 and the fourth connector 78 may be comprised of various fastening devices such as but not limited to wire, cord, plastic straps, rubber bands, neoprene strips, elastic bands, non-elastic bands, hook and loop fastener strips and the like. In addition, various guides and aiming aides may be attached to the first aperture 52 and the second aperture 54.

Figure 8:
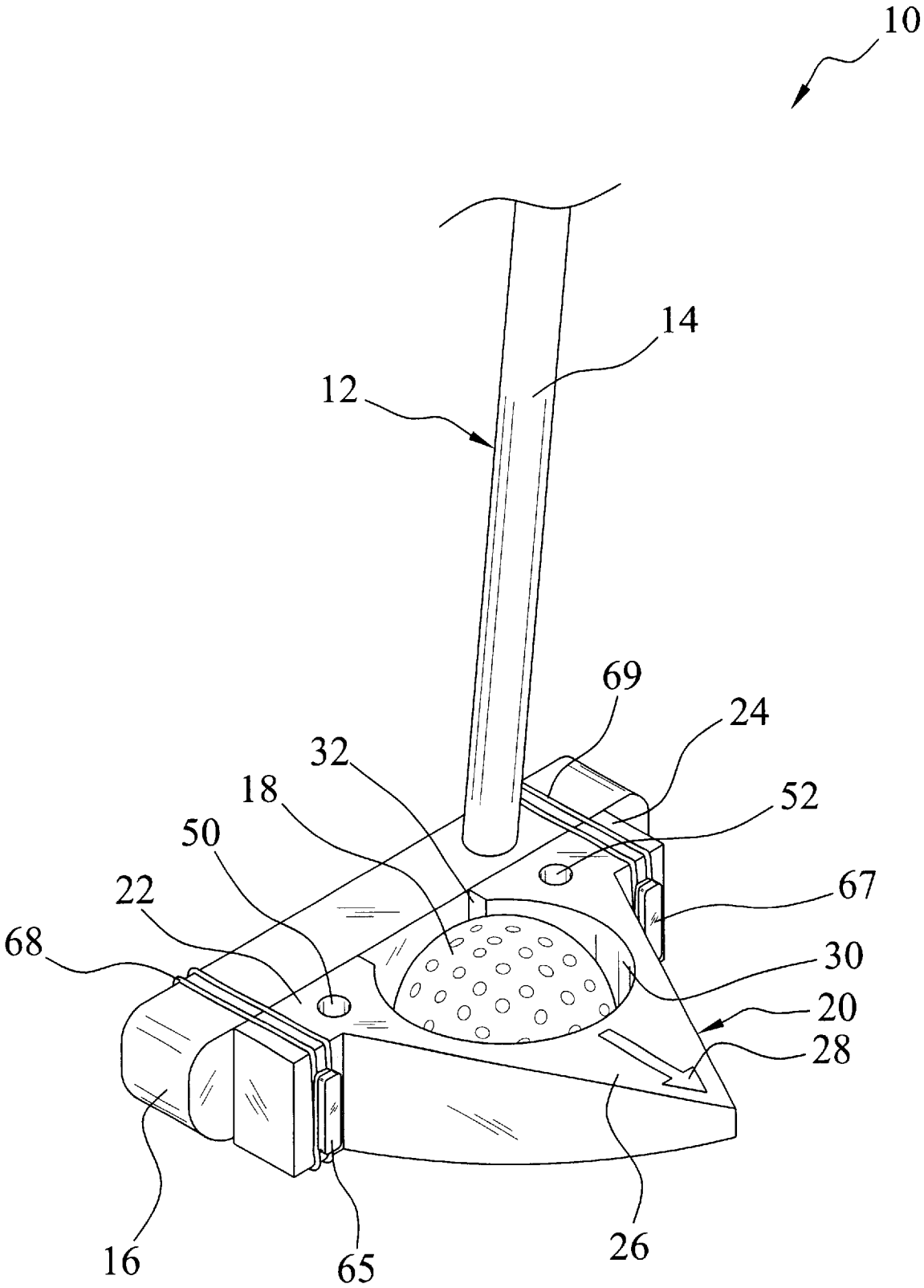
FIG. 8 is a front upper perspective view of a second alternative attachment method.
Figure 9:
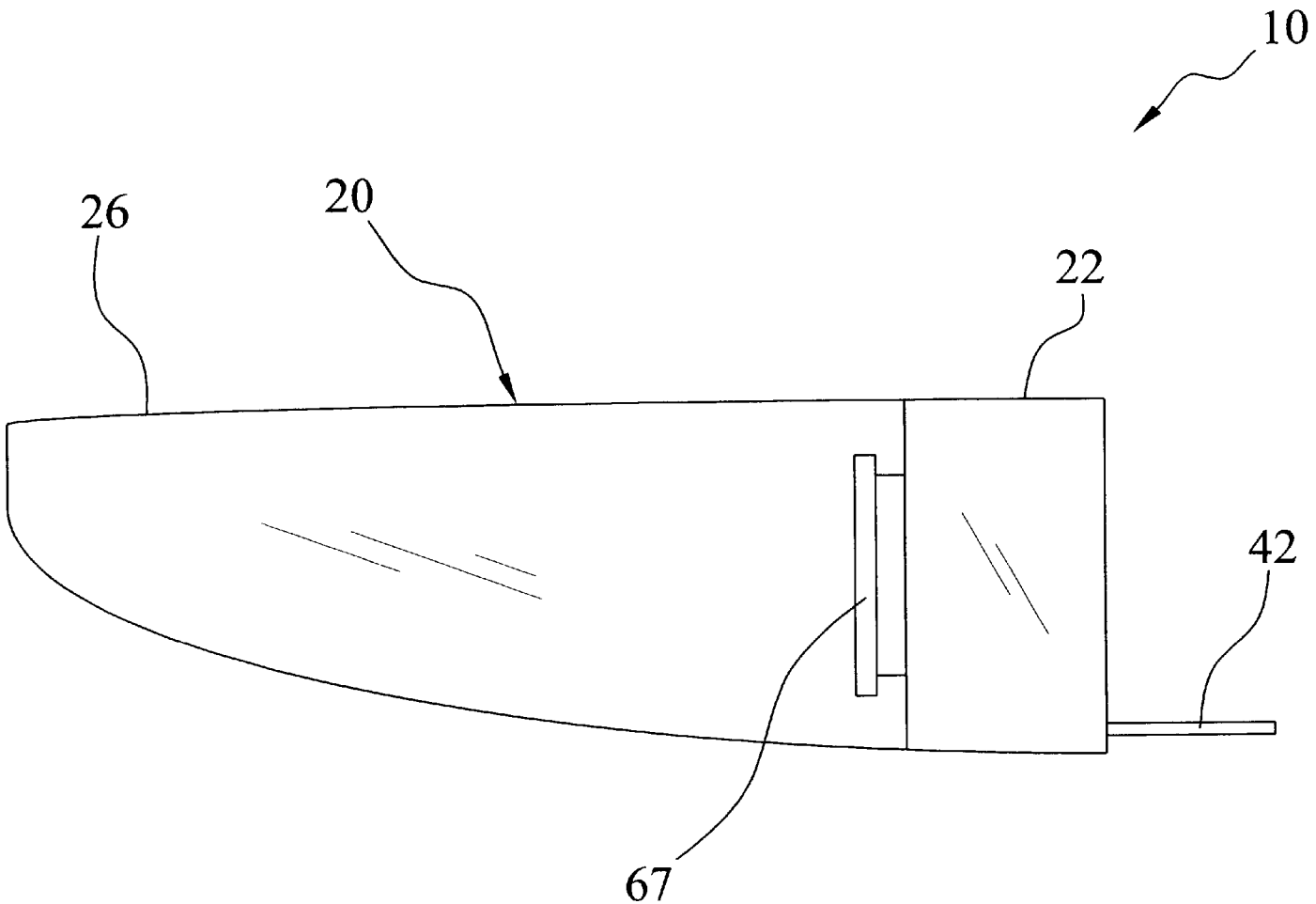
FIG. 9 is a side view of the second alternative attachment method.

As shown in FIG. 8 of the drawings, an alternative attachment structure may be utilized wherein a first bracket 65 and a second bracket 67 extend forwardly from the first rear portion 22 and the second rear portion 24 of the body 20. The brackets 65, 67 preferably have a shaft structure with a flanged distal end as best illustrated in FIG. 9 of the drawings. FIG. 9 further illustrates the brackets 65, 67 having a T-shaped structure for receiving the first connector 68 and the second connector 69 in an overlapped manner. The brackets 65, 67 may have various other extended structures that receive the first connector 68 and the second connector 69 for securing the body 20 to the putter head 16.

Figure 6A:
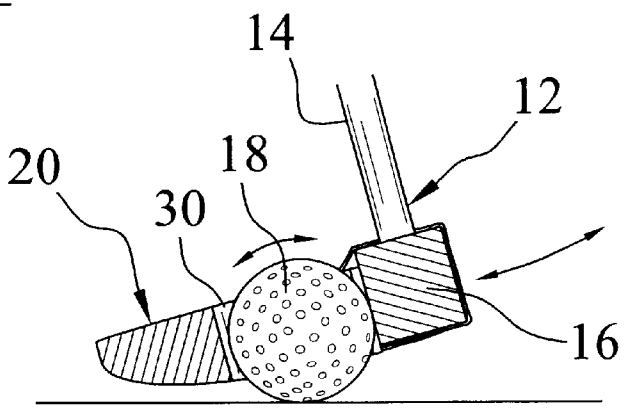
FIG. 6*a* is a side cutaway view of the present invention attached to a putter club moving forwardly from a rear position.
Figure 6B:
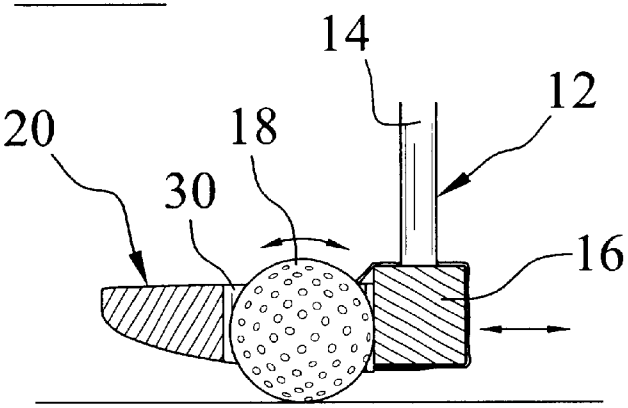
FIG. 6*b* is a side cutaway view of the present invention attached to a putter club moving forwardly from a middle position.
Figure 6C:
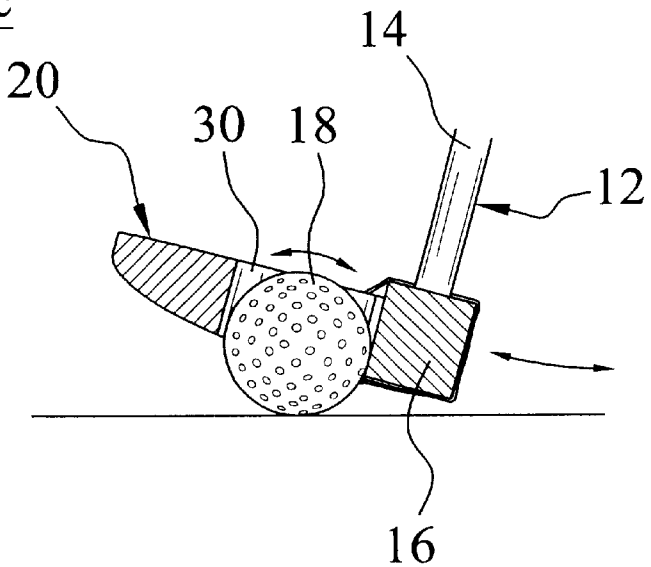
FIG. 6*c* is a side cutaway view of the present invention attached to a putter club moving forwardly from a front position.
Figure 6D:
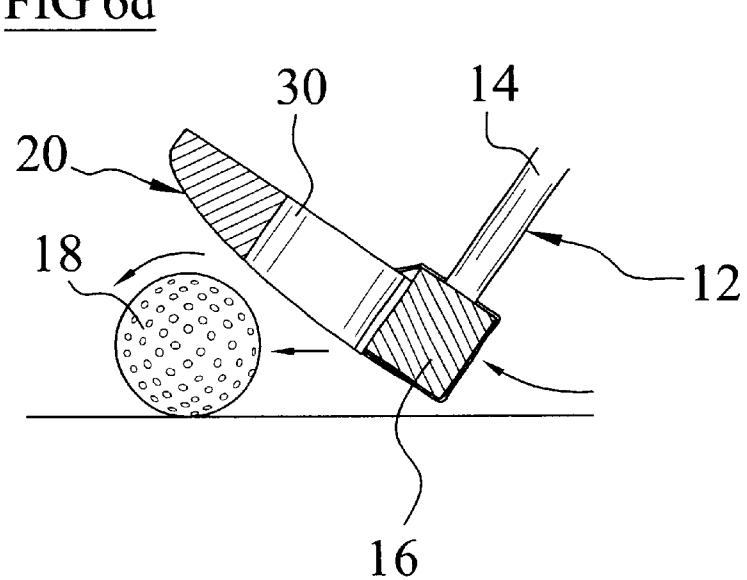
FIG. 6*d* is a side cutaway view of the present invention attached to a putter club moving forwardly with the golf ball being properly released.

In use, the user positions the rear edge of the body 20 adjacent to the face of the putter club 12 with the brace members 40, 42 positioned beneath the lower edge of the putter head 16. The user then secures the body 20 to the putter head 16 using the first connector 68 and the second connector 69 as shown in FIGS. 4 and 5 of the drawings. FIG. 7 illustrates the alternative securing system for the present invention as discussed previously. The user then positions the golf ball 18 within the main aperture 30 of the body 20 and then aims the putter head 16 at a desired target. The user then preferably swings the putter club 12 in an oscillating pendulum manner as if they were engaging the golf ball 18 to perform their shot at the target as shown in FIGS. 6*a–c*. During the practice swinging of the putter head 16, the golf ball 18 is preferably free to rotate within the main aperture 30 while engaging the ground surface as shown in FIGS. 6*a–c*. If the user is accelerating in an uneven manner, the golf ball 18 will engage the sides of the main aperture 30 physically indicating to the user that their swing requires adjustment. If the user is decelerating the putter head 16 toward the end of the swing, the golf ball 18 will engage the front inner side of the main aperture 30 indicating that the putter head 16 has been undesirable decelerated. The user repeats this process until a controlled putter head 16 velocity and acceleration are achieved for the putting swing. The user may then fully extend the putter head 16 forwardly and upwardly until the ball is fully released from the main aperture 30 of the body 20 rolling toward the target as shown in FIG. 6*d* of the drawings. In order to accomplish a proper release of the golf ball 18 from the main aperture 30, the user must make a controlled, smooth and gradually accelerating pendulum-putting stroke.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A golf putter training system, comprising:

a body having a rear portion and a front portion;

an attachment structure for securing said body to a face of a putter head;

the attachment structure having a first bracket extending forwardly from a first rear portion of said body, a first connector extendable about said putter head and connectable to said first bracket at opposing ends thereof, a second bracket extending forwardly from a second rear portion of said body, and a second connector extendable about said putter head and connectable to said second bracket at opposing ends thereof;

a main aperture within said body capable of receiving a golf ball in a rotatable manner; and a rear opening within said rear portion of said body, wherein said rear opening is connected to said main aperture for allowing a golf ball within said main aperture to engage said face of said putter head.

2. The golf putter training system of claim 1, wherein a diameter of said main aperture is at least 0.01 inch greater than an outer diameter of a golf ball.

3. The golf putter training system of claim 1, wherein a diameter of said main aperture is at least 1.69 inches.

4. The golf putter training system of claim 1, wherein a diameter of said main aperture is at least 1.63 inches.

5. The golf putter training system of claim 1, wherein a diameter of said main aperture is approximately 1.72 inches.

6. The golf putter training system of claim 1, wherein a diameter of said main aperture is between 1.70 to 1.90 inches.

7. The golf putter training system of claim 1, wherein said attachment structure is comprised of:

a first aperture extending within an upper part of said rear portion of said body;

an elongate attachment member having an upper portion and a lower portion, wherein said lower portion is positioned within said first aperture; and at least one connector extendable about a shaft of said putter club and said upper portion of said attachment member.

8. The golf putter training system of claim 7, including a second aperture extending within said upper part of said rear portion of said body opposite of said first aperture for receiving said lower portion of said attachment member.

9. A golf putter training system, comprising:

a body having a rear portion and a front portion;

an attachment structure for securing said body to a face of a putter head;

the attachment structure having a first upper member extending forwardly from a first rear portion of said body, a first lower member extending forwardly from a first rear portion of said body, a first connector extendable about said putter head and connectable to said first upper member and said first lower member at opposing ends thereof, a second upper member extending forwardly from a second rear portion of said body, a second lower member extending forwardly from a second rear portion of said body, and a second connector extendable about said putter head and connectable to said second upper member and said second lower member at opposing ends thereof;

a main aperture within said body capable of receiving a golf ball in a rotatable manner; and a rear opening within said rear portion of said body, wherein said rear opening is connected to said main aperture for allowing a golf ball within said main aperture to engage said face of said putter head.

10. A golf putter training system, comprising:

a body having a rear portion and a front portion;

an attachment structure for securing said body to a face of a putter head;

the attachment structure having a first bracket extending forwardly from a first rear portion of said body, a first connector extendable about said putter head and connectable to said first bracket at opposing ends thereof, a second bracket extending forwardly from a second rear portion of said body, and a second connector extendable about said putter head and connectable to said second bracket at opposing ends thereof;

a main aperture within said body capable of receiving a golf ball in a rotatable manner;

a rear opening within said rear portion of said body, wherein said rear opening is connected to said main aperture for allowing a golf ball within said main aperture to engage said face of said putter head; and at least one brace member having a flat structure extending rearward from said rear portion for engaging a lower edge of said putter head.

11. The golf putter training system of claim 10, wherein a diameter of said main aperture is at least 0.01 inch greater than an outer diameter of a golf ball.

12. The golf putter training system of claim 10, wherein a diameter of said main aperture is at least 1.69 inches.

13. The golf putter training system of claim 10, wherein a diameter of said main aperture is at least 1.63 inches.

14. The golf putter training system of claim 10, wherein a diameter of said main aperture is approximately 1.72 inches.

15. The golf putter training system of claim 10, wherein a diameter of said main aperture is between 1.70 to 1.90 inches.

16. The golf putter training system of claim 10, wherein said attachment structure is comprised of:

a first aperture extending within an upper part of said rear portion of said body:

an elongate attachment member having an upper portion and a lower portion, wherein said lower portion is positioned within said first aperture; and at least one connector extendable about a shaft of said putter club and said upper portion of said attachment member.

17. A golf putter training system, comprising:

a body having a rear portion and a front portion;

an attachment structure for securing said body to a face of a putter head;

the attachment structure having a first upper member extending forwardly from a first rear portion of said body, a first lower member extending forwardly from a first rear portion of said body, a first connector extendable about said putter head and connectable to said first upper member and said first lower member at opposing ends thereof, a second upper member extending forwardly from a second rear portion of said body, a second lower member extending forwardly from a second rear portion of said body, and a second connector extendable about said putter head and connectable to said second upper member and said second lower member at opposing ends thereof;

a main aperture within said body capable of receiving a golf ball in a rotatable manner;

a rear opening within said rear portion of said body, wherein said rear opening is connected to said main aperture for allowing a golf ball within said main aperture to engage said face of said putter head; and at least one brace member having a flat structure extending rearward from said rear portion for engaging a lower edge of said putter head.

18. A method of using a golf putter training device, said golf putter training device including a body having a rear portion, an attachment structure securing said body to a putter head of a putter club, a main aperture within said body capable of receiving a golf ball in a rotatable manner, and a rear opening within said rear portion of said body connected to said main aperture, said method comprising the steps of:

(a) positioning a golf ball within said main aperture;

(b) swinging said putter club in an oscillating-pendulum manner at least two complete motions without releasing said golf ball within said main aperture; and (c) releasing said golf ball from said main aperture as said putter head moves forwardly toward a final forward end point.

* * * * *